United States Patent [19]

Hudd

[11] 4,214,625

[45] Jul. 29, 1980

[54] CONTINUOUS CASTING OF METALS

[75] Inventor: Anthony W. Hudd, Sutton Coldfield, England

[73] Assignee: IMI Refiners Limited, West Midlands, England

[21] Appl. No.: 956,989

[22] Filed: Nov. 1, 1978

[30] Foreign Application Priority Data

Nov. 16, 1977 [GB] United Kingdom ..... 47664/77

[51] Int. Cl.[2] ..... B22D 11/128

[52] U.S. Cl. ..... 164/420; 164/448

[58] Field of Search ..... 164/420, 442, 448; 29/110

[56] References Cited

FOREIGN PATENT DOCUMENTS 779656 7/1957 United Kingdom ..... 164/448

OTHER PUBLICATIONS

"Development of Continuous Casting of Copper Slab and Billet at IMI Refiners Limited"; Hudd, A. W. The Metallurgist and Materials Technologists, Nov. 1977, pp. 617–620.

*Primary Examiner*—Robert D. Baldwin

*Attorney, Agent, or Firm*—Cushman, Darby & Cushman

[57] ABSTRACT

The invention is concerned with support rolls for continuous casting machines and such continuous casting machines. In a continuous casting machine the strands being cast are each supported by individual pinch rolls. The invention provides a pinch roll assembly capable of supporting more than one strand simultaneously, the pinch roll being mounted on a drive shaft by means of a spherical bearing so that the roll can articulate on the shaft. A compression spring arrangement is provided so that articulation can occur only when a lateral force greater than a predetermined value is applied to the roller. The invention also provides continuous casting apparatus incorporating such pinch rolls.

15 Claims, 3 Drawing Figures

CONTINUOUS CASTING OF METALS

BAKCKGROUND OF THE INVENTION

This invention relates to apparatus for the continuous casting of metals, especially of copper or copper alloys in the form of billets or slabs, and to a roll device for use in such apparatus.

In one process for the continuous casting of copper slabs or billets, molten copper is continuously fed into a water-cooled, graphite-lined mould from which the cast copper, known as "a strand," issues in a downward direction. The mould is reciprocated vertically during casting to free the moulded copper from the sides of the mould and at the same time the strand is moved downwardly at an appropriate rate, and is supported by a pair of spring-loaded pinch rolls mounted below the mould on horizontal drive shafts. The strand is then cut, for example by means of a flying saw, into desired lengths typically between 500 and 3,000 mm.

In order that the maximum utilization of equipment is made it is normally advantageous to cast as much material at the same time as can be arranged with the equipment available. Thus the maximum quantity of material can be cast when the strand is in the form of a rectangular cross-sectional slab which has as large a size as possible given the overall dimensions of the machine. In certain cases, however, it is desirable to cast circular cross-sectional strands, normally referred to as billets. The normal method adopted in such an arrangement is to replace the slab mould with a billet mould having two apertures which fit within the cross-section of the largest slab mould so that the billets can be cut by the flying saw normally used to cut the slabs. It is conventionally arranged, with one typical continuous casting machine, that there is provided an assembly comprising four pinch rolls. Two pairs of rolls are used when two strands are being cast simultaneously and only a single pair is used when a slab is being cast. The rolls are movable laterally with respect to descending strands of cast material and can be forced into contact with the strands to support and guide them during downward movement.

In certain circumstances it is required to cast relatively small diameter billets. If small diameter moulds are used then the casting rate is reduced—the casting rate being limited by the solidification rate of the metal within the moulds. Because it is necessary to support each strand, for reasons which will be described below, continuous casting machines utilizing four pinch rolls have hitherto been adaptable to casting a maximum of two billets irrespective of the diameter of the billets.

Although it is possible to continuously cast four strands of material arranged in a line this involves the use of eight pinch rolls and would require a very substantial modification of a single or twin strand apparatus.

SUMMARY OF THE INVENTION

The present invention provides a method whereby a relatively simple modification of a continuous casting apparatus adapted to cast one or two strands of metal may enable four strands to be cast without any need to provide additional drive shafts and pinch rolls. For this the four strands are cast with their axes lying at four corners of a quadrilateral that circumscribes the slab profile rather than being in line. This modification also enables all four strands to be cut in a single saw cycle.

For casting four strands the invention uses only two pairs of pinch rolls, as in the twin strand apparatus, each pair being associated with two strands. This is achieved using rolls that are longer than those used in the single or twin strand method. However, continuously cast strands from time to time have surface imperfections which tend locally to increase their diameter. When four strands are cast simultaneously using only two pairs of pinch rolls a small momentary different in the diameter of one of the two strands of a pair may cause unequal gripping forces on the pair of strands and this may result in one of the strands dropping through the rolls. In the present invention this problem is solved by articularly mounting one of the rolls of a pair on its shaft (for example by means of a spherical bearing) whereby the roll can tilt relative to the shaft in a horizontal plane so that the roll always exerts substantially the same gripping force on both strands of a pair irrespective of any differences in diameter of those strands. However, because both the roll and its shaft may rotate, an articulated mounting which permits horizontal tilting also permits the roll to be tiltable relative to its shaft in any plane containing the shaft axis. This, in turn, gives rise to the problem of the roll undesirably tilting in a vertical plane if, for example, a small difference in the throughput rate of the two strands of a pair occurs as a result. For example, of a small difference in the diameters of the roll where it contacts its respective strand. Such a difference can be caused by uneven wear of the roll after prolonged use of the apparatus or might even occur initially as a result of inaccurate machining of the roll. This problem has been solved by providing resilient means which permit tilting of the roll, relative to its shaft, in any particular plane containing the shaft axis only when a lateral force greater than a predetermined magnitude is applied to the roll in that particular plane.

The present invention therefore provides a roll device for use in the continuous casting of a metal, particularly copper or a copper alloy, comprising a roll adapted for mounting on a shaft, the rotational axis of the roll when mounted on the shaft being tiltable relative to the rotational axis of the shaft in any plane containing said axis of the shaft and, associated with said roll, resilient means normally maintaining said axes coaxial with one another but permitting tilting of said roll axis in any particular plane containing said shaft axis only upon the application of a force of at least a predetermined magnitude in a direction substantially transverse to the roll axis and within said particular plane.

Preferably the roll device of the invention is adapted to be used as at least one of a pair of pinch rolls accommodating simultaneously two strands of continuously cast metal. The other roll of the pair may be of the standard type but will, of course, be longer to accommodate two strands simultaneously. In accordance with standard practice, one or both rolls of a pair are grooved to locate the cast strand. Accordingly the device of the invention and/or the other roll of a pair which includes a roll device of the invention are provided with a pair of strand accommodating spaced annular grooves formed in or on the external circumferential surface of thr roll(s).

The roll device of the invention is preferably adapted for mounting on its shaft by means of a spherical bearing which will allow tilting of the roll axis relative to the shaft axis in any plane containing the shaft axis.

Desirably spaced annular grooves formed in or on the external circumferential surface of the roll device may be positioned on axially opposite sides of the spherical bearing.

The resilient means in the roll device of the invention preferably is adapted to extend between the external surface of the shaft or an extension thereof and the internal surface of a cylindrical member rigidly and coaxially attached to one end of the roll. The cylindrical member may be formed integrally with the roll although for the convenience of manufacture it is preferably welded and/or bolted onto the roll. The resilient means preferably comprises a plurality of springs arranged symmetrically around, and radiating from, the shaft, one end of each spring bearing on the internal surface of the cylindrical member and the other end of each spring bearing on a second and smaller cylindrical member rotatably mounted on the shaft, preferably by ball, or other type of, bearings. In order to achieve a perfectly stabilised system, there may be of the order of twenty compression springs, eg sixteen to twenty-four springs preferably alternately arranged to each side of a plane extending transversely to the axis of the shaft.

The compression springs are such that, during casting, they will compressively yield only when there is applied to the roll a lateral force of at least a predetermined magnitude. The value of this magnitude may be determined by simple calculation and the springs may be pre-loaded accordingly by external adjusting means. As an example, it will be assumed that both pinch rollers themselves of a pair are urged, by a separate spring system, against a strand with a force of 4 Tons, which is a typical value for continuous casting apparatus, and that the rolls are made of steel. The coefficient of friction between the surface of the steel rolls and a copper billet passing between the rolls will be of the order of 0.1. The frictional force tending to prevent relative movement between the steel and copper surfaces is, therefore, about 0.4 Ton. If, therefore, each compression spring is pre-loaded such that it will not yield until, say, a lateral force of 0.5 Ton or more applies to the roll device, tilting of the roll in a vertical plane is prevented. Tilting in a horizontal plane can, however, occur as the force exerted by an increased diameter portion of a billet will far exceed 0.5 ton. The strands will, therefore, always be firmly gripped by the pinch rolls.

The present invention also provides apparatus for the continuous casting of a metal, particularly copper or a copper alloy, by a process in which molten metal is fed to a mould from which solidified metal strands issue in a downward direction, the solidified metal being supported during downward movement by pairs of pinch rolls, said apparatus comprising at least one pair of pinch rolls adapted to support simultaneously two continuously cast metal strands and at least one of the rolls of a pair being a roll device as defined above.

The apparatus of the invention is advantageously adapted to cast at least four strands simultaneously. For this the apparatus includes at least two pairs of pinch rolls, each pair being adapted to supoort simultaneously two metal strands, and at least one of the rolls of each said pair being a roll device as defined above.

It will be appreciated that the roll device of the invention may be easily substituted for an existing roll of a pair of pinch rolls of a twin strand casting appratus and that, by additionally changing the other roll of each pair and the mould base of such an apparatus, a two strand apparatus can quickly be converted to an apparatus adapted to cast simultaneously four strands of metal with their axes lying at four corners of a quadrilateral, preferably a rectangle. It has been found that such modifications can be effected within the accepted times for more normal changes eg twin to twin strand of different sizes.

BRIEF DESCRIPTION OF THE DRAWINGS

A device and apparatus constructed in accordance with the invention will now be described by way of example only with reference to the accompanying drawings, of which.

DESCRIPTION OF THE PREFERRED EMBODIMENTS

Figure 1:
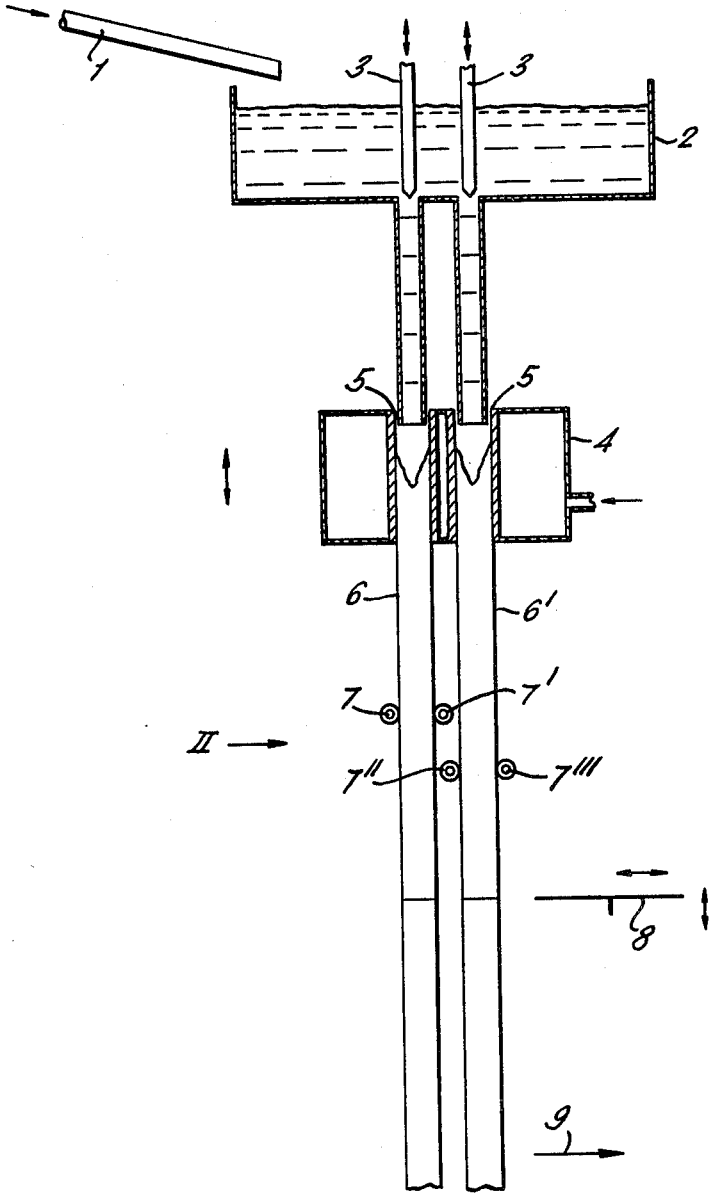
FIGS. 1 and 2 are schematic end elevations, partly in section, of continuous casting apparatus including a roll device of the invention.
Figure 2:
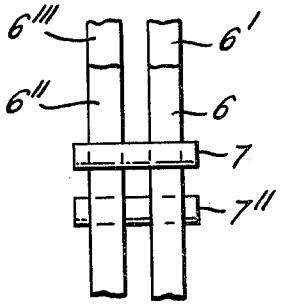

Referring to FIG. 1 of the drawings, molten copper, for example, is fed in the direction of the arrow down a launder 1 from a melting furnace (not shown) into a holding furnace 2 which includes metal flow control valves 3 for controlling flow of metal into two moulds 4. The moulds 4 include graphite liners 5 and are water cooled, the water inlet direction being indicated by the arrow. The moulds 4 are reciprocated in a vertical direction and four cast copper billets 6, 6', 6'' and 6''' of circular cross-section issue from the bottom of the moulds 4, two from each mould. As can be seen from FIGS. 1 and 2, the axes of the four billets 6, 6', 6'' and 6''' lie at the four corners of a rectangle. The cast billets are moved in a downward direction by two pairs of spring loaded pinch rolls 7, 7', 7'' and 7''' driven through a gearbox (not shown) and are then cut into desired lengths by a flying saw 8. Rolls 7 and 7''' are spring loaded by external means, whereas rolls 7' and 7'' are not externally spring loaded. The latter two rolls maintain the strands vertical and parallel to each other and are adjustable to suit the billet size. The cut lengths are rotated into a horizontal direction by a downender indicated by the arrow 9 whence the cut lengths are transported away on a conveyor system (not shown).

Figure 3:
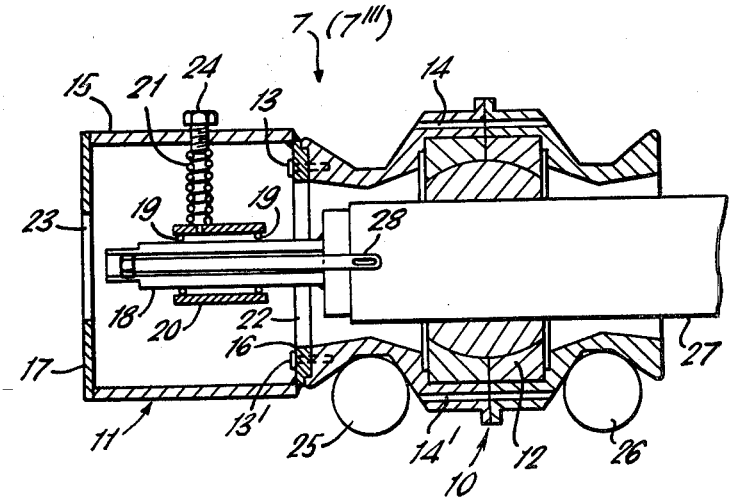
FIG. 3 is a sectional side elevation of a roll device of the invention.

The various parts of the apparatus just described, apart, of course, from the roll device of the invention, will be familiar to those skilled in the art and further explanation of their construction and operation is not necessary in this specification. The rolls 7' and 7'' are of a conventional type, longitudinally grooved to provide traction except that each is of increased length to accommodate two billets. The outermost rolls 7 and 7''' each comprises a device of the invention and will now be described in detail with reference to FIG. 3 of the drawings. The device basically comprises two portions, namely a circumferentially grooved cylindrical portion 10 and a cylindrical portion 11 rigidly and coaxially attached to the portion 10. The external contour of portion 10 is grooved to ensure that the strands track on the correct centres, but instead of being rigidly mounted on its drive shaft 27, it is mounted thereon by a spherical bearing 12 which enables the whole device to tilt about the drive shaft in any plane containing the shaft. There is no driving connection between the shaft 27 and the circumference of the work roll. To enable portion 10 to be assembled around the bearing 12, portion 10 is formed in two parts that are secured together by bolts, two of which are shown at 14 and 14'. One end of portion 10 is tapped to receive bolts, two of which are shown at 13 and 13', which secure portion 11 to portion 10. Portion 11 comprises a cylindrical member 15 and two circular end plates 16 and 17. End plate 16 is welded to member 15 and is secured to portion 10 by the bolts 13, 13' etc. End plate 17 is secured to member 15 by bolts (not shown). A generally cylindrical member 18 coaxially secured to the drive shaft 27 by a bolt 28 extends coaxially within portion 11 and has mounted on it by means of ball bearings 19 a cylindrical member 20. The member 20 acts as a support for twenty radial, pre-loaded compression springs distributed uniformly around member 18. One of the springs is shown at 21. The springs lie alternately to both sides of a plane extending at a right angle to the axis of member 20. This arrangement gives an especially stable system and ensures that the common longitudinal axis of portions 10 and 11 are normally coaxial with the longitudinal axis of the drive shaft. End plate 16 is provided with large central aperture 22 which allows it, together with cylindrical member 15 and portion 10, to tilt about the spherical bearing 12 upon the application of a lateral force to portion 10 and against the force of some of the compression springs. End plate 17 is provided with an aperture 23 which enables access of an extractor tool (not shown) to disassemble the roll device. Some of the springs 21 will, of course, aid in such tilting. The springs 21 are, however, pre-loaded to such an extent that tilting will not occur unless the lateral force applied to portion 10 is greater than a predetermined value. As already explained, this value will usually be of the order of 0.5 Tonne in a typical casting apparatus in which the pinch rollers are spring loaded into contact with the billets with a force of 4 Tons. The actual pre-loading of the twenty springs 21 can, as will be appreciated, be derived from the minimum lateral force desired for tilting, eg 0.5 Ton, the distance from the centre point of the spherical bearing 12 to the centre point of cylindrical bearing 20 upon which springs 21 bear and the distance from the centre point of spherical bearing 12 to each line passing diametrically through portion 10 and through the base of each groove. In a preferred embodiment, these distances are 25 cm, 10 cm and 10 cm respectively and accordingly each spring 21 is pre-loaded, by means of an adjusting bolt 24, to about 72.5 kg.

During continuous casting, the device of the invention will normally be coaxial with the drive shaft 27. If, however, the diameter of one of the billets 25 or 26 suddenly increases because of, for example, a surface imperfection, the device will tilt in a horizontal plane relative to the drive shaft and the device will, therefore, still grip both billets. If, however, a differential throughput rate of the two billets occurs the device will be prevented from tilting in a vertical plane for the reasons given above, which tilting could result in one or both of the billets running out of their respective grooves. It will also be appreciated that as the articulated roll is free to rotate the driven roll supports the entire weight of both strands thus the lateral spring loaded force applied to the driven roll should take account of this. If the co-efficient of friction $\mu$ for copper/steel is 0.25 and the weight of both strands is 0.6 Ton then the lateral force required to hold the strands vertically can be calculated from $$\text{Force} = (\text{weight}/\mu) = (0.6/0.25) = 2.4 \text{ Tons}$$

Thus, allowing for a safety margin 4 Tons lateral force would be sufficient.

I claim:

1. A roll device for use in the continuous casting of metal comprising a roll having a rotational axis, and provided with a pair of strand accommodating spaced annular grooves formed in or on a continuous external circumferential surface thereof;

a shaft having a rotational axis;

means for mounting said roll on said shaft so that the rotational axis of said roll is tiltable relative to the rotational axis of said shaft in any plane containing the shaft rotational axis;

resilient means associated with said roll for normally maintaining said axes coaxial with one another and allowing tilting of said roll axis with respect to said shaft axis in any particular plane containing said shaft axis only upon the application of a force of at least a predetermined magnitude so that tilting will occur as a result of strands of differing diameters being received by said roll annular grooves, but will not occur as a result of differential throughput rates of the strands received by said roll annular grooves.

2. A device according to claim 1 wherein said means for mounting said roll on said shaft comprises a spherical bearing.

3. A roll device according to claim 2 wherein the strand accommodating spaced annular grooves are positioned on axially opposite sides of the spherical bearing.

4. A roll device according to claim 1 wherein the resilient means extends between the external surface of the shaft or an extension thereof and the internal surface of a cylindrical member rigidly and coaxially attached to one end of the roll.

5. A roll device according to claim 4 wherein the resilient means comprises a plurality of compression springs arranged symmetrically around, and radiating from, the shaft or extension thereof, one end of each spring bearing on the internal surface of the cylindrical member and the other end of each spring bearing on a second and smaller cylindrical member rotatably mounted on the shaft.

6. A roll device according to claim 5 wherein said second cylindrical member is mounted on the shaft by ball or other bearings.

7. A roll device according to claim 5 having of the order of twenty springs.

8. A roll device according to claim 5 having sixteen to twenty-four springs.

9. A roll device according to claim 1 adapted to be used as at least one of a pair of pinch rolls accommodating simultaneously two strands of continuously cast metal.

10. A roll device according to claim 1 wherein the springs are alternately arranged to each side of a plane extending transversely to the axis of the shaft.

11. A roll device according to claim 1 wherein said predetermined magnitude is about 0.5 Ton.

12. Apparatus for the continuous casting of a metal comprising means for feeding molten metal to a mould from which solidified strands issue in a downward direction; and a pair of pinch roll devices for supporting said strands during downward movement thereof; wherein the improvement comprises at least one of said roll devices comprising:

a roll having a rotational axis, and provided with a pair of strand accommodating spaced annular grooves formed in or on a continuous external circumferential surface thereof;

a shaft having a rotational axis;

means for mounting said roll on said shaft so that the rotational axis of said roll is tiltable relative to the rotational axis of said shaft in any plane containing the shaft rotational axis; and resilient means associated with said roll for normally maintaining said axes coaxial with one another and allowing tilting of said roll axis with respect to said shaft axis in any particular plane containing said shaft axis only upon the application of a force of at least a predetermined magnitude so that tilting will occur as a result of strands of differing diameters being received by said roll annular grooves, but will not occur as a result of differential throughput rates of the strands received by said roll annular grooves.

13. Apparatus according to claim 12 wherein the mould is adapted to cast at least four strands of metal simultaneously.

14. Apparatus according to claim 13 wherein the mould is adapted to cast simultaneously four strands of metal with their axes lying at four corners of a quadrilateral.

15. Apparatus according to claim 14 wherein the mould is adapted to cast simultaneously four strands of metal with the axes of the metal strands lying at the four corners of a rectangle.

* * * * *